US005187924A

United States Patent [19]

Marshall

[11] Patent Number: 5,187,924

[45] Date of Patent: Feb. 23, 1993

[54] SADDLE

[76] Inventor: Robert L. Marshall, Rte. 2, Box 306B, Salem, Ky. 42078

[21] Appl. No.: 647,279

[22] Filed: Jan. 29, 1991

[51] Int. Cl.[5] ..... B68C 1/02

[52] U.S. Cl. ..... 54/44.5; 54/44.7

[58] Field of Search ..... 54/44, 65, 66

[56] References Cited

U.S. PATENT DOCUMENTS

| | | | |
|---|---|---|---|
| 233,816 | 10/1880 | Straus | 54/44 |
| 3,157,976 | 11/1964 | Ellsworth | 54/44 |
| 4,771,590 | 9/1988 | Bates | 54/44 |
| 4,860,524 | 8/1989 | Dumoulin et al. | 54/44 |
| 4,965,988 | 10/1990 | Anderson | 54/44 |

*Primary Examiner*—Robert P. Swiatek

[57] ABSTRACT

A saddle defined by padding presenting an upper layer and a lower layer, webbing straps embedded between the layers of padding, and front and rear tree sections connected to the padding and independently movable with respect to each other and responsive to the movement of a horse. The arrangement is such as to provide a seating area between the front and rear tree sections and to, thereby, distribute pressure onto a large area on the horse's back, eliminating the necessity of bulky riggings and heavy leather straps, and, as well, to afford the rider added comfort and considerably closer contact with the horse that has been possible by saddles previously in use.

3 Claims, 2 Drawing Sheets

SADDLE

BACKGROUND OF THE INVENTION

As is known, the use of saddles in connection with horseback training/riding is widespread, oftentimes requiring a specialized form(s) for a particular purpose. A difficulty with present arrangements is the provision of a rigid tree disposed between the rigid front frame or tree and the rigid cantle frame on the rear of the saddle.

SUMMARY OF THE INVENTION

In contrast, the invention presents a front tree and a rear tree connected to a flexible saddle pad or base defined as two layers of cellular foam rubber or neoprene.

Such an arrangement achieves (for the rider) the security of a conventional saddle, but, at the same time, the feel of riding bareback. The arrangement also affords the horse much more freedom of movement than a saddle with a conventional rigid tree(s). The invention places the rider and the horse in as close contact as possible, but still with comfort to both, and, also, a maximum amount of security for the rider.

Importantly, the padding involved herein comprises two layers of closed cellular rubber material, cut and laminated together, as by a strong flexible contact adhesive, and in such a manner so that the padding is contoured and/or preshaped to fit the horse.

The saddle presented by the invention is defined by a minimum number of components arranged and/or assembled to eliminate bulky rings, metal hardware, and heavy leathers, irrespective of position and with consideration to either the rider and/or the horse, being a serious problem inherent with saddles in use heretofore.

DESCRIPTION OF THE DRAWINGS

A better understanding of the present invention will become more apparent with the following description, taken in conjunction with the accompanying drawings, wherein.

Figure 1:
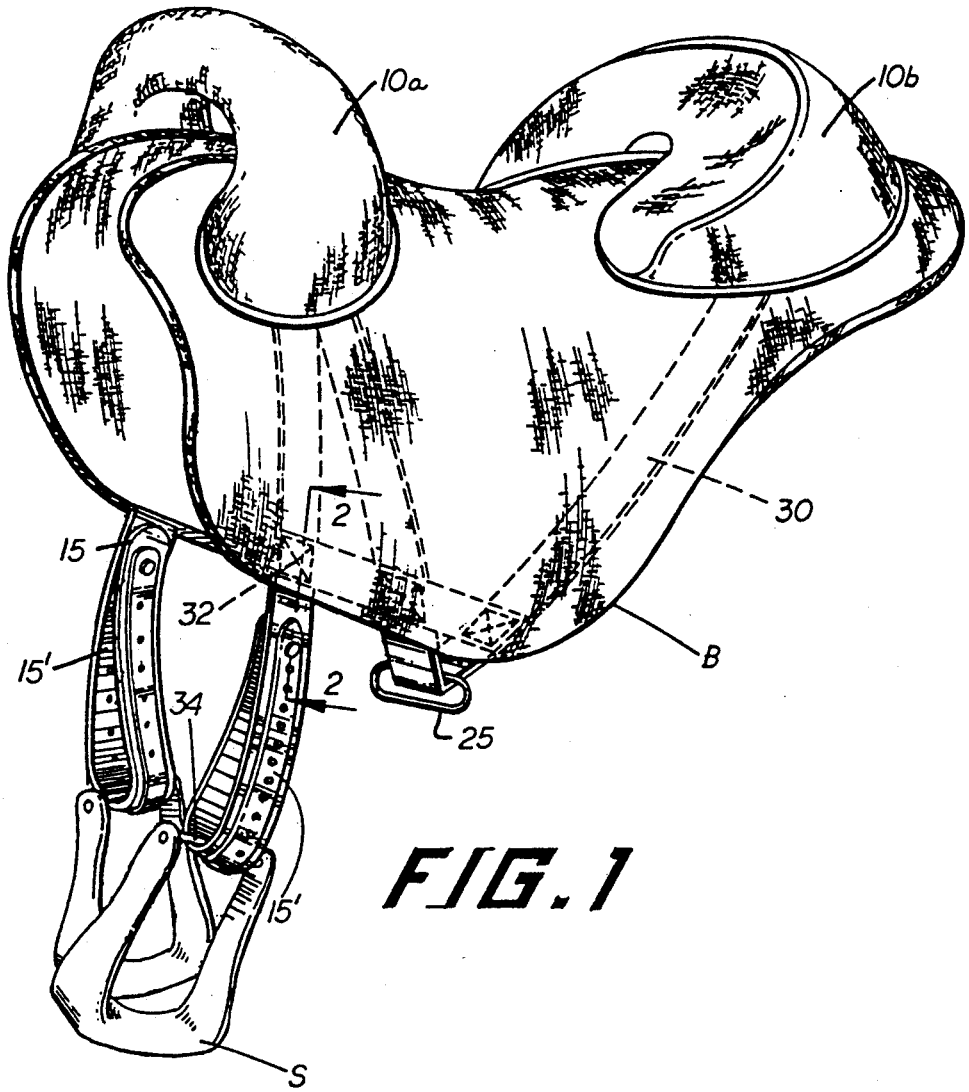
FIG. 1 is a perspective view of a saddle in accordance with the teachings of the present invention and pre-fit and/or preshaped for ready conformity with the shape of a horse.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

Figure 2:
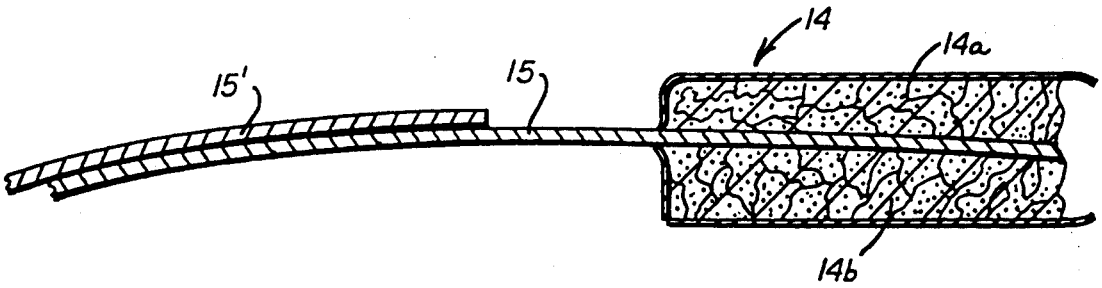
FIG. 2 is a detailed view showing a typical assembly of webbing straps on the pads defining the instant saddle, taken at line 2—2 on FIG. 1 and looking in the direction of the arrows.
Figure 3:
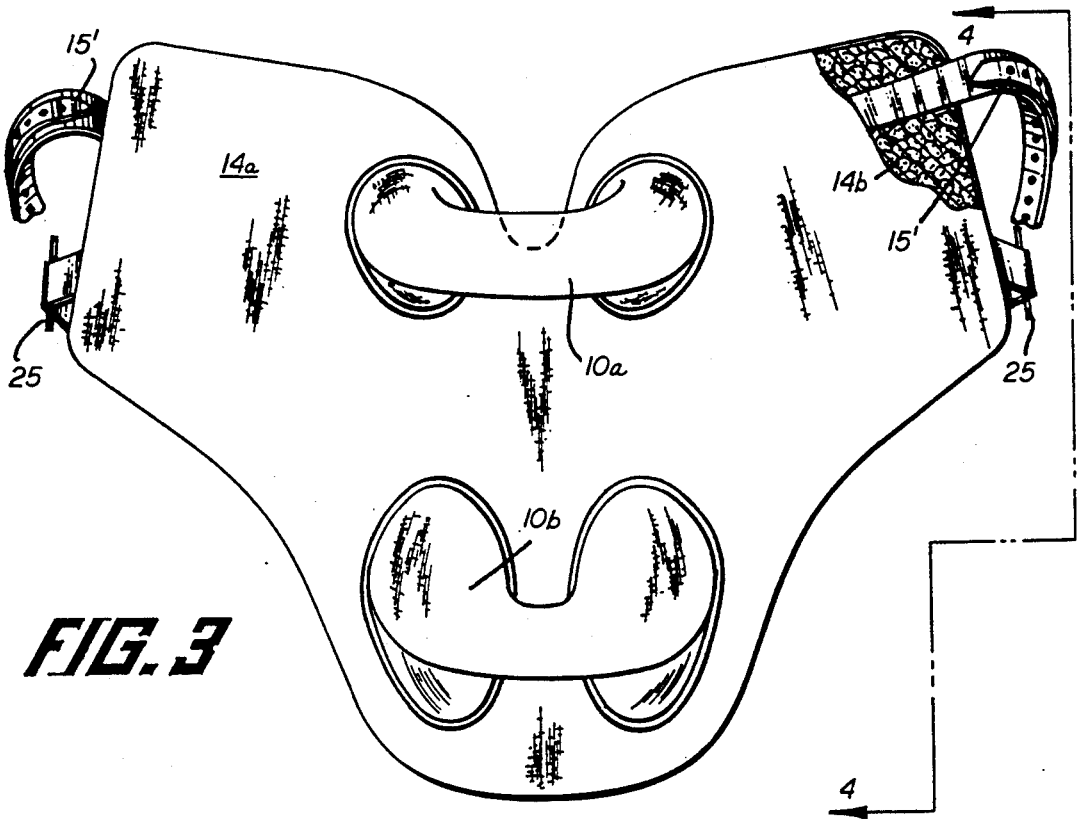
FIG. 3 is a top plan view of the saddle of the invention, laid out in a generally planer relationship and looking principally from right to left in FIG. 1.
Figure 4:
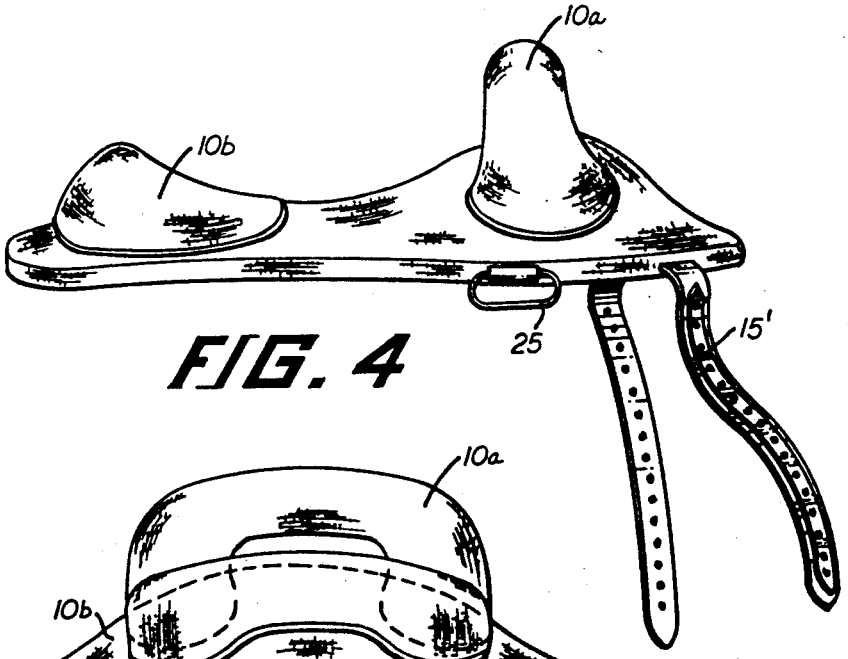
FIG. 4 is a view in side elevation, taken at line 4—3 of FIG. 3 and looking in the direction of the arrows, further detailing the invention; and, FIG. 5 is a view in end elevation of the instant saddle, looking from left to right in the showing of FIG. 4.
Figure 5:
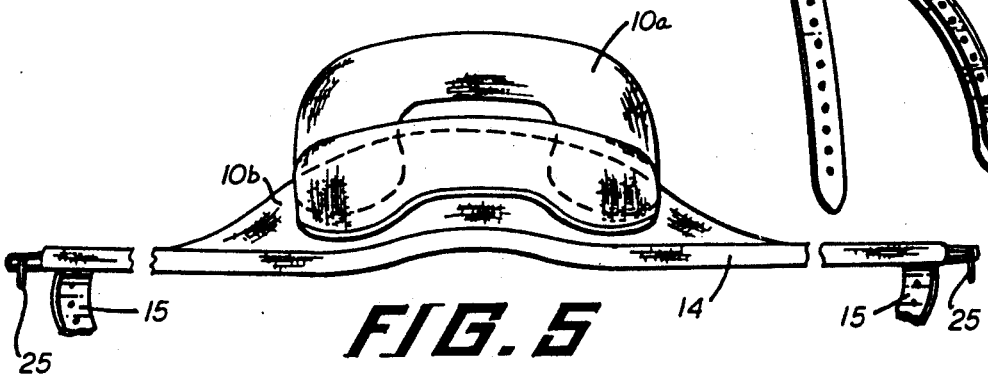

Referring now to the figures, and particularly to FIGS. 1 and 2, the saddle of the invention is defined by a front tree section 10*a* and a rear tree section 10*b*, independently movable with respect to each other and responsive to movement of a horses, being firm in form and serving to maintain the ride correct position on the horse, in the mid-area of such saddle sections, for proper balance. Webbing straps 15, typically flat and in a 2" width, are embedded within padding 14 for connecting the front tree part of the saddle to section 10*a*, straps 15,15, position the stirrups, and metal loop(s) 25, serving, with straps, cinch purposes. The webbing straps are each embedded within the padding 14 (see FIG. 2).

It should be evident at this point that the instant arrangement serves to distribute pressure over a large area on the horse's back, eliminates the necessity of bulky riggings and heavy leather straps and, at the same time, affords the rider added comfort and much closer contact with the horse then saddles previously in use.

In any event, the saddle herein will be defined as comprised of various parts including the front and rear tree sections, respectively, 10*a*,10*b*; padding 14; rigging design and material; cinch and stirrup straps; and covering material, all arranged in a manner to accomplish ready assembly.

In addition to FIGS. 1 and 2, FIGS. 3, 4 and 5 add to the presentation, where, for example, the front tree section 10*a* and the rear tree section 10*b* are each in a form of a laminated wooden frame, where the bottom edge of each is typically reinforced with fiberglass to avoid splitting and/or chipping during nailing and/or stapling.

The upper portion of each tree section 10*a*,10*b* is developed to aid the rider in maintaining the proper position and balance on the horse, while the bottom portion is contoured to comfortably fit the horse and maintain the proper position of the saddle on the horse.

Various materials may be employed to cover the tree sections 10*a*,10*b*, including, by way of example, leather, vinyl, and stretch nylon, each presenting a predesired color.

The padding 14 is defined by two layers (14*a*,14*b*) of cellular neoprene or rubber which are cut and laminated together, as by use of a strong flexible contact adhesive, and in such a manner that the padding is contoured to the shape of a horse's back.

The FIG. 2 showing of the padding 14 does not necessarily reflect the layers, but, on the other hand, the juncture between such is a rather fine line and/or irregular and would not necessarily demonstrate a substantial straight line of sufficient width for a drawing showing.

The front and rear tree sections 10*a*,10*b* are secured to the cinch by means of webbing straps, i.e. "rigging straps," which are secured to the bottom side of the front and rear tree sections 10*a*,10*b*. The webbing straps are layered between the layers of cellular foam in the padding 14 (as discussed already with respect to FIG. 2), where the "rigging straps" extend through a metal loop 25 at the bottom edge of the padding 14, running down to the cinch (not shown) where such is tightly drawn together by means of a cinch buckle.

The stirrup straps 15,15' are attached to lower portions of the padding 14, each strap comprising a web disposed or layered between the two layers of cellular rubber or neoprene of the padding 14. A small length of stirrup strap is secured to the "rigging straps" so as to prevent the stirrups (not shown) from swinging too far forwardly and/or overstretching or tearing the padding 14. A buckle is attached to the upper end of each stirrup and appropriate reinforcement is provided.

The covering materials have already been described, where it should be mentioned that each are preferably washable in nature so as to maintain cleanliness during use.

Assembly is readily accomplished, where, at the outset, the front and rear tree sections **10*a*,10*b*** are typically covered with stretch nylon having a rubber backing, where a contact adhesive serves assembly. The use of rubber backing on the nylon fabric achieves superior bonding properties.

Assembly is completed through the use of adhesive and, as a final stage, the edges are trimmed and stretched over each other to present a finished border with no visible stitching.

From the preceding, it should be evident that the saddle presented herein utilizes the most modern materials for assembly and achieves maximum comfort and security for the rider, with the latter affording complete feel and contact with the horse.

The invention improves the balance and coordination between the horse and the rider by placing the rider as close as possible to the horse, between the front and rear tree sections **10*a*,10*b*** and keeping the rider in the correct position on the horse and the rider's feet and legs in what is normally termed the "rider's groove," i.e. the arrangement where the horse's shoulder and rib cage come together. The latter is achieved by the manner in which the stirrup straps are positioned in the saddle.

The finished saddle is light in weight, washable, extremely comfortable, and is available in a wide variety of colors. The saddle described hereabove is susceptible to various changes within the spirit of the invention, including, by way of example, in proportioning; the selection of any of the previously mentioned material; the manner of assembly of the padding; the particular manner of securing the front and rear tree sections; and, the like. Thus, the preceding should be considered illustrative and not as limiting the scope of the following claims.

I claim:

1. A saddle comprising an upper portion and a lower portion secured together as an integral unit in intimate contact with the back of a horse, webbing straps disposed between said upper portion and said lower portion, and spaced apart front and rear tree sections each having a base connected to said upper portion and defining a seating portion therebetween, where said front and rear tree sections act independently, serving to emulate movement of said horse.

2. The saddle of claim 1 where said upper portion and said lower portion of said saddle are each a layer of cellular foam rubber.

3. The saddle of claim 1 where said webbing straps serve cinch and stirrup retaining relationships.

* * * * *